US009261833B2

(12) United States Patent
Hamilton et al.

(10) Patent No.: US 9,261,833 B2
(45) Date of Patent: Feb. 16, 2016

(54) BACKUP ROLL HAVING AXIAL CONSTRAINTS AND FUSER THEREFOR

(71) Applicant: Lexmark International, Inc., Lexington, KY (US)

(72) Inventors: Douglas Campbell Hamilton, Lexington, KY (US); Fangsheng Wu, Lexington, KY (US); Michael Alan Cleary, Lexington, KY (US)

(73) Assignee: Lexmark International, Inc.KY (US)

( * ) Notice: Subject to any disclaimer, the term of this patent is extended or adjusted under 35 U.S.C. 154(b) by 0 days.

(21) Appl. No.: 14/517,671

(22) Filed: Oct. 17, 2014

(65) Prior Publication Data

US 2015/0110534 A1 Apr. 23, 2015

Related U.S. Application Data

(60) Provisional application No. 61/892,414, filed on Oct. 17, 2013.

(51) Int. Cl.
*G03G 15/20* (2006.01)

(52) U.S. Cl.
CPC ..... *G03G 15/2053* (2013.01); *G03G 15/206* (2013.01); *G03G 2215/0132* (2013.01); *G03G 2215/2035* (2013.01)

(58) Field of Classification Search
CPC ..... G03G 15/206; G03G 15/2089
See application file for complete search history.

(56) References Cited

U.S. PATENT DOCUMENTS

| | | | | |
|---|---|---|---|---|
| 2004/0033092 | A1* | 2/2004 | Aruga | 399/329 |
| 2006/0289028 | A1* | 12/2006 | Lee et al. | 132/229 |
| 2009/0047047 | A1* | 2/2009 | Ardery et al. | 399/329 |

* cited by examiner

*Primary Examiner* — David Gray
*Assistant Examiner* — Michael Harrison

(57) ABSTRACT

A fuser assembly for an imaging device is shown and described. The fuser assembly includes a heat transfer member for generating heat and a backup roll coupled to the heat transfer member and rotatable therewith. The backup roll includes a central core and a rubber layer surrounding the central core. The fuser assembly further includes a plurality of end cap members, each end cap member being disposed at an end of the backup roll and dimensioned for substantially preventing outward expansion of the rubber layer in an axial direction of the backup roll.

19 Claims, 5 Drawing Sheets

BACKUP ROLL HAVING AXIAL CONSTRAINTS AND FUSER THEREFOR

CROSS REFERENCES TO RELATED APPLICATIONS

Pursuant to 35 U.S.C. §119, this application claims the benefit of the earlier filing date of Provisional Application Ser. No. 61/892,414, filed Oct. 17, 2013, entitled "Fuser Backup Roll Thermal Axial Constraint and Fuser Therefor," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to preventing or reducing treeing effects on media sheets imaged by electrophotographic imaging devices, and particularly to the use of end cap members associated with the backup roll of a fuser assembly for such imaging devices.

2. Description of the Related Art

Current belt fuser assemblies of electrophotographic imaging devices include a metal belt encasing a ceramic slab heater, and a backup roll having a silicone rubber layer and a smooth polyperfluoroalkoxy-tetrafluoroethylene (PFA) sleeve at least partly surrounding the rubber layer. In the fuser assembly, the backup roll and the belt with the heater are pressed together to form the fuser nip, which is the surface area that the media sheets contact and pass through in order to fuse a toner image on the sheet to the sheet itself. The metal belt may be a Teflon coated metal belt for monochrome imaging devices or a metal tube with a rubber layer and a PFA sleeve for color imaging devices.

"Treeing" is an effect that occurs when the sheet passes through the fuser nip and begins to corrugate and then eventually fold in on itself. Certain inconsistencies in the media sheet or printer design will cause the sheet to be compressed along its width such that wrinkles begin to form in the sheet. If these wrinkles become severe, treeing will occur. The result of treeing is that a crease is formed down the length of the media sheet that varies in length and depth.

Many known factors lead to treeing, the most common issues. For instance, treeing is more likely to occur when the media sheet is skewed as it enters the fuser nip, i.e., the leading edge of the sheet is not parallel with the fuser nip. Further, treeing is known to occur if the profile of the fuser nip is improperly designed or manufactured. Another factor that may cause treeing is the media sheet absorbed moisture from its environment, causing it to have a wavy edge and/or inconsistent width along the length of the sheet.

Accordingly, there is a need for an improved system for reducing or otherwise eliminating the occurrence of treeing in electrophotographic imaging devices.

SUMMARY

Embodiments of the present disclosure are directed to a fuser assembly for an imaging device, including a heat transfer member for generating heat; a backup roll coupled to the heat transfer member and rotatable therewith. The backup roll includes a central core and a rubber layer surrounding the central core. The fuser assembly further includes a pair of end cap members, each end cap member being disposed at an end of the backup roll and dimensioned for substantially preventing outward expansion of the rubber layer in an axial direction of the backup roll.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
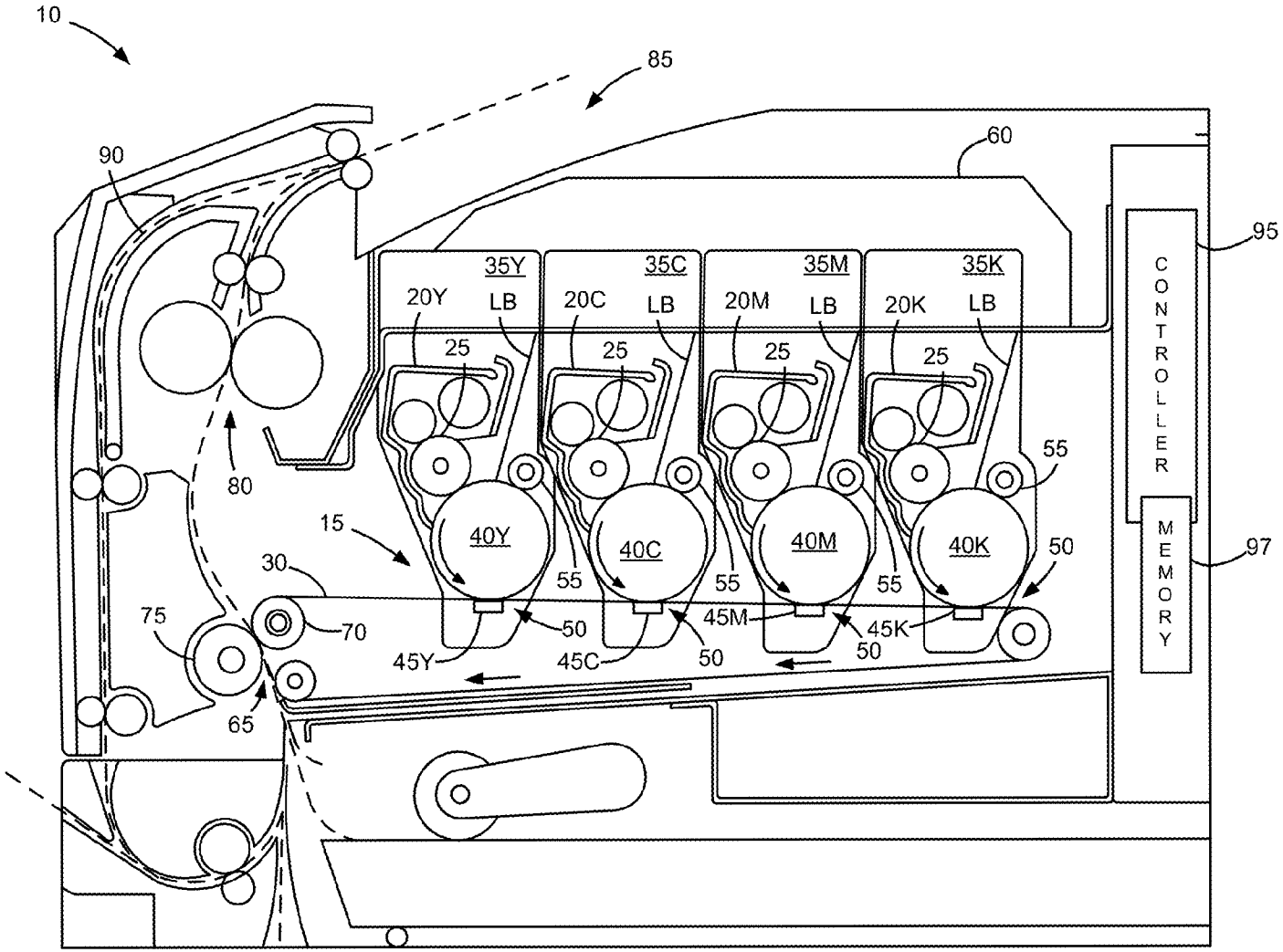
FIG. 1 is a schematic illustration of an image forming device including a fuser assembly according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates an image forming device 10 according to an example embodiment. Image forming device 10 includes a first toner transfer area 15 having four developer units 20, including developer rolls 25, that substantially extend from one end of image forming device 10 to an opposed end thereof. Developer units 20 are disposed along an intermediate transfer member (ITM) 30. Each developer unit 20 holds a different color toner. The developer units 20 may be aligned in order relative to the direction of the ITM 30 indicated by the arrows in FIG. 1, with the yellow developer unit 20Y being the most upstream, followed by cyan developer unit 20C, magenta developer unit 20M, and black developer unit 20K being the most downstream along ITM 30.

Each developer unit 20 is operably connected to a toner reservoir 35 for receiving toner for use in a printing operation. Each toner reservoir 35 is controlled to supply toner as needed to its corresponding developer unit 20. Each developer unit 20 is associated with a photoconductive member 40 that receives toner therefrom during toner development to form a toned image thereon. Each photoconductive member 40 is paired with a transfer member 45 to define a transfer station 50 for use in transferring toner to ITM 30 at first transfer area 15.

During color image formation, the surface of each photoconductive member 40 is charged to a specified voltage by a charge roller 55. At least one laser beam LB from a printhead or laser scanning unit (LSU) 60 is directed to the surface of each photoconductive member 40 and discharges those areas it contacts to form a latent image thereon. In one embodiment, areas on the photoconductive member 40 illuminated by the laser beam LB are discharged. The developer unit 20 then transfers toner to photoconductive member 40 to form a toner image thereon. The toner is attracted to the areas of the surface of photoconductive member 40 that are discharged by the laser beam LB from LSU 60.

ITM 30 is disposed adjacent to each of developer unit 20. In this embodiment, ITM 30 is formed as an endless ITM disposed about a drive roller and other rollers. During image forming operations, ITM 30 moves past photoconductive members 40 in a clockwise direction as viewed in FIG. 1. One or more of photoconductive members 40 applies its toner image in its respective color to ITM 30. For mono-color images, a toner image is applied from a single photoconductive member 40K. For multi-color images, toner images are applied from two or more photoconductive members 40. In one embodiment, a positive voltage field formed in part by transfer member 45 attracts the toner image from the associated photoconductive member 40 to the surface of moving ITM 30.

ITM 30 rotates and collects the one or more toner images from the one or more photoconductive members 40 and then conveys the one or more toner images to a media sheet at a second transfer area 65. Second transfer area 65 includes a second transfer nip formed between a back-up roller 70 and a second transfer member 75.

A fuser assembly 80 is disposed downstream of second transfer area 65 and receives media sheets with the unfused toner images superposed thereon. In general terms, fuser assembly 80 applies heat and pressure to the media sheets in order to fuse toner thereto. After leaving fuser assembly 80, a media sheet is either deposited into an output media area 85 or enters duplex media path 90 for transport to second transfer area 65 for imaging on a second surface of the media sheet.

Image forming device 10 is depicted in FIG. 1 as a color laser printer in which toner is transferred to a media sheet in a two step operation. Alternatively, image forming device 10 may be a color laser printer in which toner is transferred to a media sheet in a single step process—from photoconductive members 40 directly to a media sheet. In another alternative embodiment, image forming device 10 may be a monochrome laser printer which utilizes only a single developer unit 20 and photoconductive member 40 for depositing black toner directly to media sheets. Further, image forming device 10 may be part of a multi-function product having, among other things, an image scanner for scanning printed sheets. Still further, image forming device 10 may utilize other processes and/or architectures for transferring toner to media sheets, such as a dual component based architecture.

Image forming device 10 further includes a controller 95 and an associated memory 97. Memory 97 may be any volatile and/or non-volatile memory such as, for example, random access memory (RAM), read only memory (ROM), flash memory and/or non-volatile RAM (NVRAM). Alternatively, memory 97 may be in the form of a separate electronic memory (e.g., RAM, ROM, and/or NVRAM), a hard drive, a CD or DVD drive, or any memory device convenient for use with controller 95. Though not shown in FIG. 1, controller 95 may be coupled to components and modules in image forming device 10 for controlling same. For instance, controller 95 may be coupled to toner reservoirs 35, developer units 20, photoconductive members 40, fuser assembly 80 and/or LSU 60 as well as to motors (not shown) for imparting motion thereto. It is understood that controller 95 may be implemented as any number of controllers and/or processors for suitably controlling image forming device 10 to perform, among other functions, printing operations.

Figure 2:
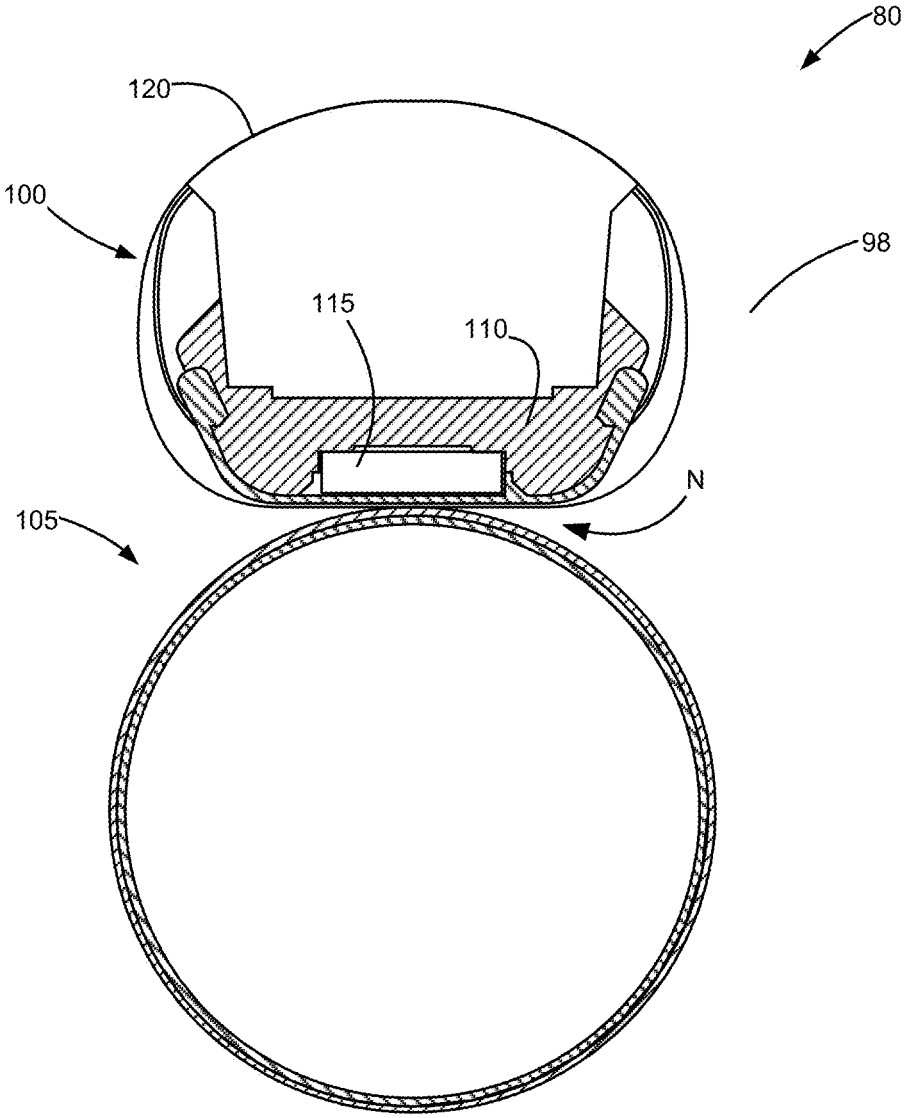
FIG. 2 is a cross sectional view of the fuser assembly in FIG. 1.

With reference to FIG. 2, fuser assembly 80 includes a heat transfer member 100 and a backup roll 105 cooperating with the heat transfer member 100 to define a fuser nip N for conveying media sheets therein. The heat transfer member 100 may include a housing 110, a heater element 115 supported on or at least partially in housing 110, and an endless flexible fuser belt 120 positioned about housing 110. Heater element 115 has a length that extends substantially perpendicular to a media feed direction and may be formed from a substrate of ceramic or like material to which one or more resistive traces are secured which generate heat when a current is passed therethrough. Heater element 115 may further include at least one temperature sensor, such as a thermistor, coupled to the substrate for detecting a temperature of heater element 115. It is understood that heater element 115 alternatively may be implemented using other heat generating mechanisms. For instance, heat transfer member 100 may be a hot roll for a hot roll based fuser architecture.

Fuser belt 120 is disposed around housing 110 and heater element 115. Backup roll 105 contacts fuser belt 120 such that fuser belt 120 rotates about housing 110 and heater element 115 in response to backup roll 105 rotating. With fuser belt 120 rotating around housing 110 and heater element 115, the inner surface of fuser belt 120 contacts heater element 115 so as to heat fuser belt 120 to a temperature sufficient to perform a fusing operation to fuse toner to sheets of media.

Backup roll 105 includes a central core constructed from metal or the like and a rubber layer, such as a silicone rubber layer, surrounding the core. In addition, backup roll 105 may include a smooth sleeve made from PFA.

In an example embodiment, the profile of fuser nip N has a substantially hourglass shape. An hourglass shape ensures that fuser nip N will touch the ends of the leading edge of a sheet of media to be fused before the middle portion thereof. A substantially hourglass shape can be manipulated with changes to fuser belt 120, backup roll 105, the force applied to the ends of fuser belt 120 and backup roll 105, and the deflection of the heater assembly. Two non-trivial variables that were found to help the nip profile and have a significant effect on avoiding treeing are the profile of backup roll 105 as well as the profile of fuser belt 120.

Figure 3:
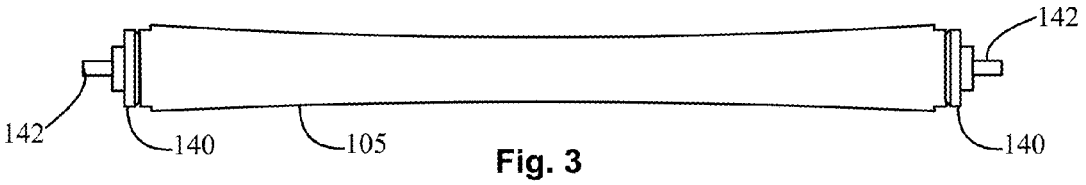
FIG. 3 is a side view of a backup roll and end caps of the fuser assembly of FIG. 2.

In an example embodiment, fuser belt 120 is a profiled stainless steel belt and backup roll 105 has a straight (e.g., cylindrical) core with a profiled rubber layer. A profiled shape means that there is a larger diameter at the ends of each of backup roll 105 and fuser belt 100 than in the corresponding middle portions. FIG. 3 illustrates the profile for backup roll 105. The difference in radius from middle to end on fuser belt 100 is between about 80 μm and about 120 μm, such as 100 μm; and the difference between the middle and ends of backup roll 105 is between about 180 μm and about 220 μm, such as 200 μm. These profiles serve to provide the desired nip profile and move the longitudinal edges of the media sheets faster through fuser nip N compared to the longitudinal center portions thereof. This puts tension along the length of the media sheet in the lateral direction(s) and allows fuser assembly 80 to stretch or pull the sheet to avoid and/or remove corrugations on the sheet.

Even with fuser belt 100 and backup roll 105 having crowned profiles as described above, treeing continued to be occasionally observed at ambient conditions on high toner coverage pages. After observing pages going through from a cold start (when fuser backup roll 105 and belt 120 are at room temperature), it was also noticed that corrugation along the media sheet worsened as time went on and backup roll 105 became hotter. It is believed that as backup roll 105 increased in temperature, the profiled rubber layer thereof was losing its desired effect as it thermally expanded outwardly in the axial plane or direction of backup roll 105. Also, when there is a relatively high amount of toner on the media sheet, the sheet is no longer being driven (or less driven) by the fuser belt 100 and is instead driven by backup roll 105. In a second embodiment, also depicted in FIG. 3, a crowned core of backup roll 105 having a smaller diameter at its longitudinal ends than in the middle portion thereof was employed for the purpose of providing more rubber at the ends of backup roll 105, therefore maintaining the desired larger diameter and circumference on the ends of the roll. This would provide the desired velocity profile which would pull corrugation out of the media sheet in the transverse direction relative to the direction of media as the media sheet is passed through the fuser assembly 80.

During fusing operations, the rubber layer of backup roll 105 is seen to undesirably undergo thermal expansion in the outward, axial direction, relative to the rotational axis of backup roll 105, which altered the profile of the rubber layer and/or backup roll 105 and adversely affected the ability of fuser nip N to pull a media sheet in a lateral direction as the sheet passed through it. Accordingly, example embodiments include a pair of end caps 140, each of which is attached to shaft 142 of backup roll 105. End caps 140 are sized and shaped to contact the rubber layer of backup roll 105 so as to prevent the rubber layer from outwardly expanding in the axial direction of backup roll 105 and thereby maintain the crowned shape for substantially eliminating or otherwise reducing treeing on the fused sheet. End caps 140 are constructed from a rigid material, such a metal.

Figure 4:
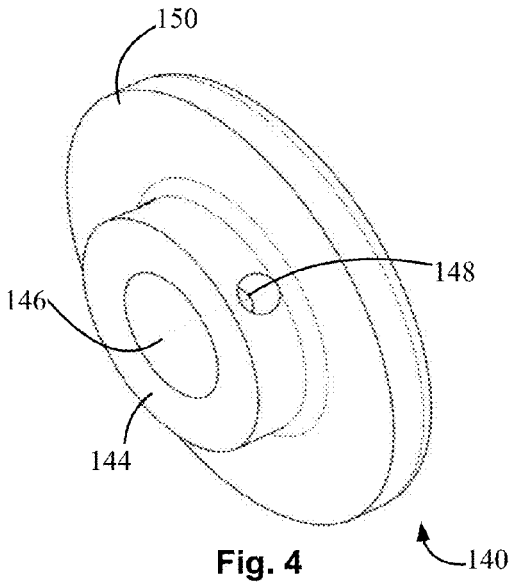
FIGS. 4 and 5 are perspective views of the end cap member for the fuser assembly of FIG. 2, according to an example embodiment.
Figure 5:
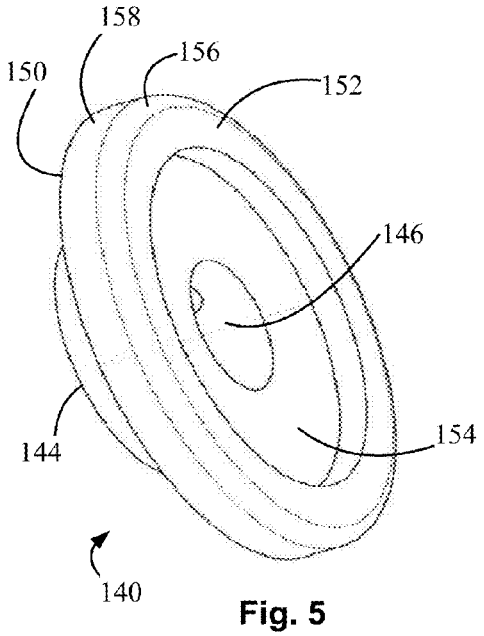

FIGS. 4 and 5 illustrate an end cap 140 and FIG. 3 shows end caps 140 connected to backup roll 105. End cap 140 includes a first portion 144 that extends from one end to a second end thereof. First portion 144 includes a through hole 146 through which shaft 142 of backup roll 105 is disposed. First portion 144 also includes a threaded bore 148 for receiving a set screw so that end cap 140 may be fixedly secured to shaft 142.

End cap 140 also includes a second portion 150 which extends radially outwardly from first portion 144. The extent second portion 150 radially extends outwardly from first portion 144 is such that a contact surface 152 contacts the rubber layer of backup roll 105 when end cap 140 is secured to shaft 142 of backup roll 105, and prevents the rubber layer from expanding outwardly in the axial direction of backup roll 105. The outer diameter of second portion 150 is between about 26 mm and about 30 mm, such as 28 mm The surface area of contact surface 152 is sized to prevent such axial expansion of the rubber layer. Radially inward from contact surface 152 is a recessed area 154. Recessed portion 154 may have an outer diameter between about 18 mm and about 24 mm, such as 21 mm, and may be recessed about 1.5 mm from contact surface 152. Recessed portion 154 allows for more even contact of contact surface 152 of end cap 140 with the rubber layer of backup roll 105 without being constrained by the metal core thereof. In addition, recessed portion 154 allows for more relaxed tolerance of the end of rubber layer of backup roll 105.

In an example embodiment, first portion 144 and second portion 150 are both constructed from metal and are integrally formed as a unitary member. In another example embodiment, all or part of first portion 144 is constructed from metal and all or part of second portion 150 is constructed from a rigid plastic that is secured to first portion 144 using an adhesive or other known securement mechanism. It is understood that other embodiments may utilize metal, plastic (with or without glass fibers) and/or other suitably rigid material.

As shown in FIG. 5, end cap 140 includes a tapered surface 156 disposed between contact surface 152 and the outermost surface 158 of end cap 140.

Figure 6:
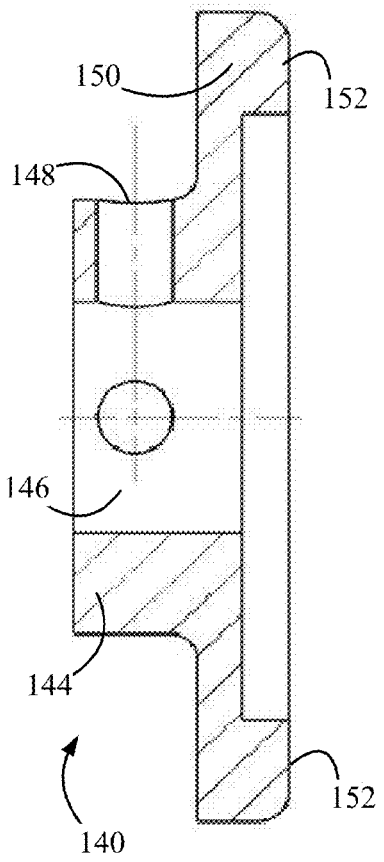
FIGS. 6 and 7 are side cross sectional views of the end cap member of FIGS. 4 and 5, according to example embodiments.
Figure 7:
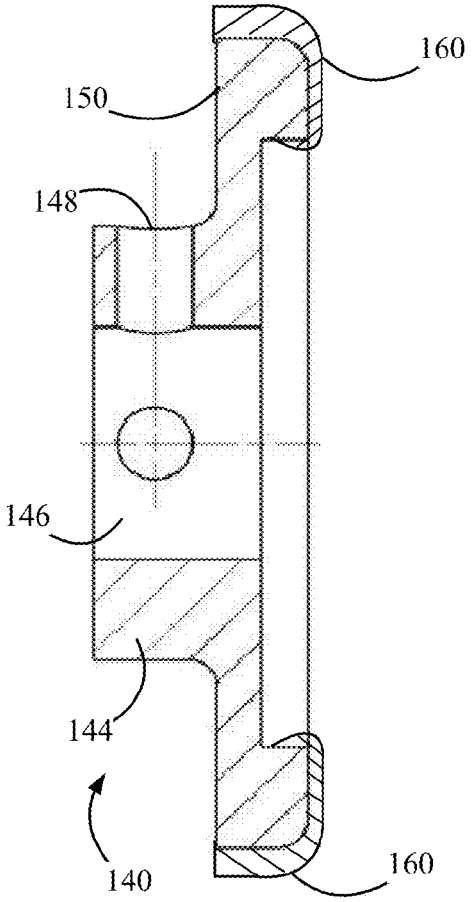

FIG. 6 shows a cross section of end cap 140 according to an example embodiment. FIG. 7 shows a cross section of end cap 140 according to a second embodiment in which a rubber layer 160 is attached to second portion 150 and form the contact surface of end cap 140 for contacting the rubber layer of backup roll 105. Rubber layer 160 may be attached to second portion 150 via an adhesive, for example. Alternatively, rubber layer 160 is a separable component from end cap 140, similar to a rubber gasket or the like, that is positioned between contact surface 152 and backup roll 105 when end cap 140 is secured to shaft 142 of backup roll 105. Because rubber layer 160 is made of rubber, its outer surface is more conformable when contacting the outwardly expanding rubber layer of backup roll 105.

Figure 8:
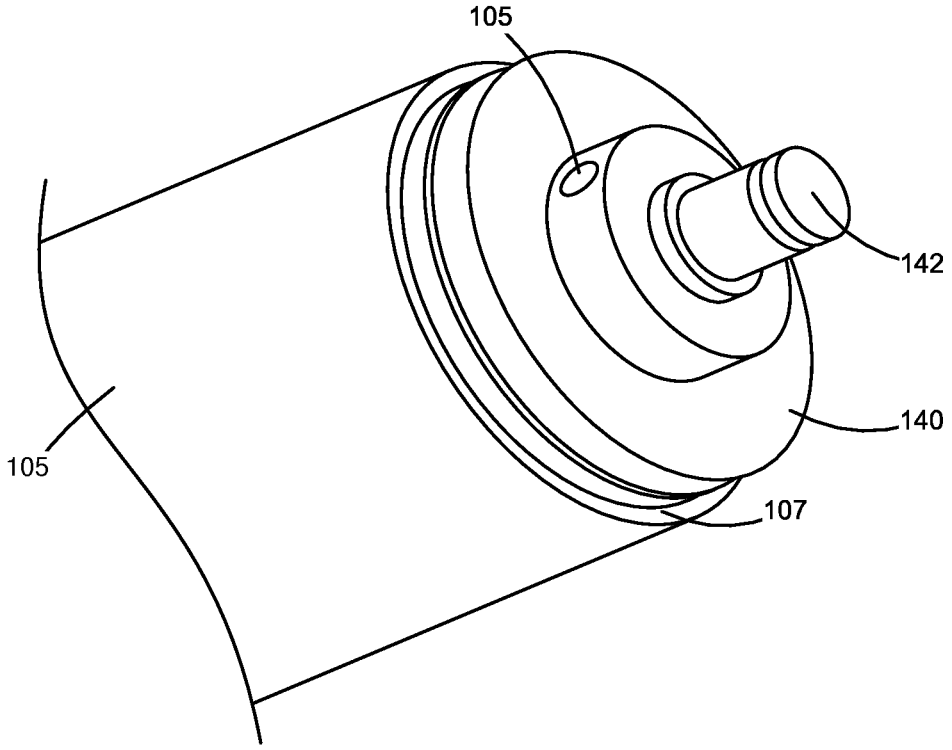
FIGS. 8 and 9 are perspective and side views, respectively, of an end of the backup roll of FIG. 3.
Figure 9:
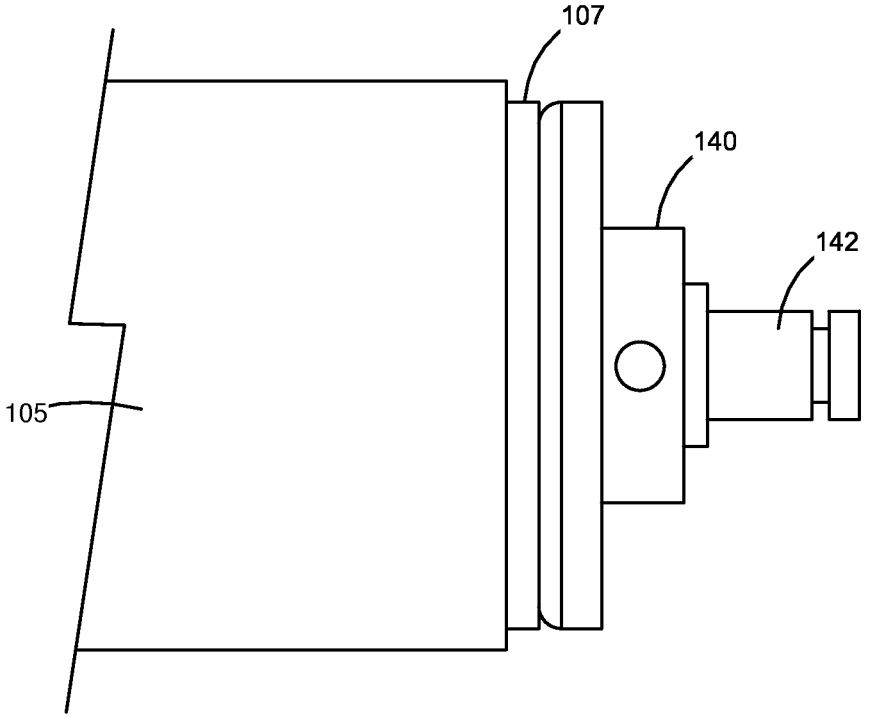

FIGS. 8 and 9 illustrate an end cap 140 connected to shaft 142 of backup roll 105. In an example embodiment, the rubber layer and/or PFA sleeve of backup roll 105 may include a cutaway section 107 at each end thereof. Without cutaway section 107, the rubber layer is compressed at fuser nip N and will tend to bulge over the outermost surface 158 of end cap 140, which may lead to the rubber layer of backup roll 105 being cut thereby. Cutaway section 107 serves to avoid any cutting or other adverse action of the rubber layer. In an example embodiment, cutaway section 107 is about 1 mm to about 1.5 mm deep and about 1 mm to about 1.5 mm in length in the axial direction of backup roll 105.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

The invention claimed is:

1. A fuser assembly for an imaging device, comprising:

a heat transfer member for generating heat;

a backup roll coupled to the heat transfer member and rotatable therewith, comprising a central core and a rubber layer surrounding the central core; and a plurality of end cap members, each end cap member being disposed at an end of the backup roll and dimensioned for substantially preventing outward expansion of the rubber layer in an axial direction of the backup roll;

wherein the backup roll includes a shaft about which the backup roll rotates, and each end cap member is attached to the shaft so as to rotate therewith, and wherein each end cap member includes a metal portion connecting to the shaft of the backup roll, and a rubber portion disposed between the metal portion and the backup roll and having at least one surface contacting the rubber layer of the backup roll.

2. The fuser assembly of claim 1, wherein the fuser assembly is one of a belt fuser and a hot roll fuser.

3. The fuser assembly of claim 1, wherein each end cap member includes a threaded bore for receiving a set screw therein, the set screw engaging with the shaft of the backup roll.

4. The fuser assembly of claim 1, wherein the rubber portion is attached to the metal portion with an adhesive.

5. The fuser assembly of claim 1, wherein each end cap member includes a recessed area located radially inwardly from the at least one surface.

6. The fuser assembly of claim 1, wherein the end cap member further comprises a plastic portion disposed between the metal portion and the rubber portion and secured to the metal portion.

7. The fuser assembly of claim 1, wherein the rubber portion is separable from the metal portion.

8. The fuser assembly of claim 1, wherein the backup roll further comprises a sleeve member disposed along an outer surface of the rubber layer, at least one of the rubber layer and the sleeve member including a cutaway portion proximal to each end of the backup roll.

9. The fuser assembly of claim 1, wherein the rubber layer includes a cutaway portion proximal to each end of the backup roll.

10. A fuser assembly for an imaging device, comprising:

a heat transfer member for generating heat;

a backup roll coupled to the heat transfer member and rotatable therewith, comprising a central core and a rubber layer surrounding the central core; and a plurality of end cap members, each end cap member being disposed at an end of the backup roll and dimensioned for substantially preventing outward expansion of the rubber layer in an axial direction of the backup roll;

wherein each end cap member includes a metal portion connecting the end cap member to the backup roll, and a rubber portion disposed between the metal portion and the backup roll and having at least one surface contacting the rubber layer of the backup roll.

11. The fuser assembly of claim 10, wherein the backup roll further comprises and a shaft about which the backup roll rotates and the metal portion of each end cap member includes an aperture for receiving the shaft therein, the end cap being removably attached to the shaft.

12. The fuser assembly of claim 10, wherein each end cap member includes a recessed area located radially inwardly from the at least one surface.

13. The fuser assembly of claim 10, wherein the end cap member further comprises a plastic portion disposed between the metal portion and the rubber portion and secured to the metal portion.

14. The fuser assembly of claim 10, wherein an outer surface of the backup roll includes a cutaway portion disposed in proximity to each longitudinal end of the backup roll.

15. A fuser assembly for an imaging device, comprising:

a heat transfer member for generating heat;

a backup roll coupled to the heat transfer member and rotatable therewith, comprising a central core and a rubber layer surrounding the central core; and a plurality of end cap members, each end cap member being disposed at an end of the backup roll and dimensioned for substantially preventing outward expansion of the rubber layer of the backup roll in an axial direction of the backup roll;

wherein the backup roll includes a cutaway portion located proximal to each end of the backup roll and a corresponding end cap member.

16. The fuser assembly of claim 15, wherein the backup roll further comprises a sleeve member disposed along an outer surface of the rubber layer, each cutaway portion being formed in the sleeve member.

17. The fuser assembly of claim 15, wherein the backup roll includes a shaft about which the backup roll rotates, each end cap member is attached to the shaft so as to rotate therewith, and each end cap member includes a metal portion for connecting to the shaft of the backup roll and a rubber portion disposed between the metal portion and the backup roll and having at least one surface contacting the rubber layer of the backup roll.

18. The fuser assembly of claim 15, wherein each end cap member includes a metal portion for connecting to the backup roll and a rubber portion disposed between the metal portion and the backup roll and having at least one surface contacting the rubber layer of the backup roll.

19. The fuser assembly of claim 15, wherein the cutaway portion is between about 1 mm and about 1.5 mm deep in the radial direction of the backup roll and between about 1 mm to about 1.5 mm in an axial direction of the backup roll.

* * * * *